US007654806B2

(12) United States Patent
Hanst et al.

(10) Patent No.: US 7,654,806 B2
(45) Date of Patent: Feb. 2, 2010

(54) EXTERNAL TOOTHED WHEEL PUMP COMPRISING A RELIEVING POCKET

(75) Inventors: Markus Hanst, Oberschleißheim (DE); Martin Korn, Jetzendorf (DE); Jörg Weissgärber, Munich (DE); Christof Härle, Weingarten (DE); Christof Lamparski, Mittelbiberach (DE)

(73) Assignee: Shwaebische Huettenwerke Automotive GmbH & Co. KG, Aalen-Wasseralfingen ( * ) Notice: Subject to any disclaimer, the term of this patent is extended or adjusted under 35 U.S.C. 154(b) by 0 days.

(21) Appl. No.: 11/716,296

(22) Filed: Mar. 9, 2007

(65) Prior Publication Data

US 2008/0025862 A1 Jan. 31, 2008

(30) Foreign Application Priority Data

Mar. 10, 2006 (DE) ..... 10 2006 011 200

(51) Int. Cl.

| | |
|---|---|
| ***F01C 1/18*** | (2006.01) |
| ***F01C 21/00*** | (2006.01) |
| ***F04C 2/18*** | (2006.01) |
| ***F04C 15/00*** | (2006.01) |

(52) U.S. Cl. ..... 418/206.4; 418/21; 418/189; 418/206.1

(58) Field of Classification Search ..... 418/157, 418/189, 206.4, 180, 21, 28, 205, 206.1
See application file for complete search history.

(56) References Cited

U.S. PATENT DOCUMENTS

| | | | | | |
|---|---|---|---|---|---|
| 1,458,204 | A | * | 6/1923 | Tibbetts | 418/189 |
| 1,706,829 | A | * | 3/1929 | Thomson | 418/189 |
| 1,719,025 | A | * | 7/1929 | Scheminger, Jr. | 418/189 |
| 2,884,864 | A | * | 5/1959 | Bobnar | 418/189 |
| 3,474,736 | A | * | 10/1969 | Lauck | 418/180 |
| 4,097,206 | A | * | 6/1978 | Schonherr | 418/180 |
| 4,902,202 | A | * | 2/1990 | Bowden | 417/310 |
| 5,190,450 | A | * | 3/1993 | Ghosh et al. | 418/189 |
| 6,283,735 | B1 | | 9/2001 | Schreiber et al. | |

FOREIGN PATENT DOCUMENTS

| | | |
|---|---|---|
| DE | 19847132 A1 | 4/2000 |
| DE | 10222131 A1 | 12/2003 |
| GB | 143 912 | 8/1921 |

* cited by examiner

*Primary Examiner*—Thomas E Denion
*Assistant Examiner*—Mary A Davis
(74) *Attorney, Agent, or Firm*—RatnerPrestia

(57) ABSTRACT

An external toothed wheel pump, comprising a delivery chamber comprising an inlet and an outlet for a fluid; a first feed wheel and a second feed wheel which can be rotationally driven for delivering the fluid and are in a toothed engagement with each other which separates the outlet from the inlet; and sealing surfaces which axially face the feed wheels and form axial sealing gaps with the feed wheels, wherein at least one of the sealing surfaces comprises a relieving pocket on a high-pressure side of the delivery chamber only and except for the relieving pocket, extends circumferentially up to at least the root circle and tip circle of the axially facing feed wheel.

14 Claims, 3 Drawing Sheets

EXTERNAL TOOTHED WHEEL PUMP COMPRISING A RELIEVING POCKET

This application claims priority to German Patent Application No. 10 2006 011 200.8 filed Mar. 10, 2006, which is incorporated in its entirety by reference herein.

BACKGROUND OF THE INVENTION

1. Technical Field

The invention relates to an external toothed wheel pump comprising at least one relieving pocket for draining crimp fluid from an engagement region of mutually mating feed wheels of the pump.

2. Description of the Related Art

An external toothed wheel pump follows from DE 198 47 132 C1, comprising two externally toothed feed wheels which mate with each other in toothed engagement when rotationally driven. In order to deliver a fluid to be delivered uniformly and with little pulsation, relieving pockets are worked into the sealing surfaces which axially face the front faces of the feed wheels, said pockets extending into the region of the toothed engagement, such that crimp fluid can escape from the engagement region via the relieving pockets both to the high-pressure side of the pump comprising the outlet and to the low-pressure side of the pump comprising the inlet.

SUMMARY OF THE INVENTION

In the exemplary embodiment, nowhere does the relieving pocket protrude towards the low-pressure side beyond a straight line connecting the rotational axes of the feed wheels to each other. The relieving pocket preferably exhibits at least a certain distance from said connecting straight line all over. Undesirably delivering crimp fluid from the high-pressure side to the low-pressure side is most reliably prevented when the relieving pocket exhibits a distance of about, preferably exactly, half a tooth gap width (e/2) or half a tooth thickness (e/2) of the facing feed wheel from the connecting straight line in the rotational direction of the axially facing feed wheel all over, wherein the tooth thickness (e) is measured to the reference circle of the relevant feed wheel. If the feed wheels exhibit different tooth thicknesses and tooth gap widths, the distance is preferably measured in relation to the larger of the two reference values. A deviation from half the tooth thickness (e/2) or half the tooth gap width (e/2) which does not amount to more than a tenth of the tooth thickness (e/10) or a tenth of the tooth gap width (e/2) is still regarded as being advantageous. Such a geometry. i.e. equal to e/2+-e/10(6e/10to 4e/10). of the relieving pocket towards the low-pressure side most reliably ensures that crimp fluid escapes completely from the region of the toothed engagement, but only to the high-pressure side. Eliminating crimp fluid saves on drive output, as in the known pump, however unlike the known pump, the feed flow of fluid on the low-pressure side is disrupted less and is thus kept calmer and more uniform. The suction level of the pump rises. Furthermore, a major proportion of the crimp fluid is usefully drained to the high-pressure side.

In accordance with the exemplary embodiment of the invention, such a relieving pocket in the relevant sealing surface is provided on the high-pressure side of the delivery chamber only, while the relevant sealing surface on the low-pressure side extends up to at least the root circle and tip circle of the axially facing feed wheel and together with it forms a narrow axial sealing gap which ensures the separation of the high pressure and low pressure. Due to the uninterrupted sealing surface on the low-pressure side and the axial sealing gap which is therefore long on the low-pressure side in the rotational direction of the facing feed wheel, high-pressure fluid is more reliably prevented from being transported back to the low-pressure side than in the known pump. The high-pressure fluid can only escape from the toothed engagement to the high-pressure side.

In the exemplary embodiment, nowhere does the relieving pocket protrude towards the low-pressure side beyond a straight line connecting the rotational axes of the feed wheels to each other. The relieving pocket preferably exhibits at least a certain distance from said connecting straight line all over. Undesirably delivering crimp fluid from the high-pressure side to the low-pressure side is most reliably prevented when the relieving pocket exhibits a distance of about, preferably exactly, half a tooth gap width or half a tooth thickness of the facing feed wheel from the connecting straight line in the rotational direction of the axially facing feed wheel all over, wherein the tooth thickness is measured to the reference circle of the relevant feed wheel. If the feed wheels exhibit different tooth thicknesses and tooth gap widths, the distance is preferably measured in relation to the larger of the two reference values. A deviation from half the tooth thickness or half the tooth gap width which does not amount to more than a tenth of the tooth thickness or a tenth of the tooth gap width is still regarded as being advantageous. Such a geometry of the relieving pocket towards the low-pressure side most reliably ensures that crimp fluid escapes completely from the region of the toothed engagement, but only to the high-pressure side. Eliminating crimp fluid saves on drive output, as in the known pump, however unlike the known pump, the feed flow of fluid on the low-pressure side is disrupted less and is thus kept calmer and more uniform. The suction level of the pump rises. Furthermore, a major proportion of the crimp fluid is usefully drained to the high-pressure side.

The relieving pocket is advantageously flat and preferably exhibits a uniform or maximum depth of 3 mm at most, as applicable 3.5 mm at most, wherein the depth is measured to the plane of the sealing surface. It is more preferably 2 mm deep at most, plus tolerance. On the other hand, the pocket should have a uniform or maximum depth of at least 0.5 mm.

The at least one sealing surface provided with the relieving pocket extends circumferentially, except for the relieving pocket, up to at least the root circle and tip circle of the axially facing feed wheel. Together with the feed wheel, it preferably forms a narrow sealing gap over the entire front face of the feed wheel up to its tip circle, except for the relieving pocket. It is preferably planar all over, except for the relieving pocket.

The relieving pocket preferably extends in the radial direction up to the root circle of the axially facing feed wheel and preferably also not beyond it radially inwards. It can extend counter to the rotational direction of said feed wheel, in particular up into the region of the enclosure, in order to lengthen the high-pressure region of the deliver chamber near the outlet into the enclosure. In such embodiments, the relieving pocket is sufficiently long, as measured counter to the rotational direction of the feed wheel, that it extends in the rotational direction up into the last tooth gap of the feed wheel which is still completely situated in the enclosure in all rotational angle positions of the feed wheel, but no longer extends into the penultimate tooth gap in the rotational direction. It can for example extend into the region of the enclosure over an arc length which is about as large as half the pitch of the relevant feed wheel. In particular, the relieving pocket of the driven feed wheel should not extend too far into the enclosure. Crimp fluid should only be able to flow into the enclosure of the driven feed wheel when the currently driving tooth of the driving feed wheel is only still in contact with the driven feed wheel on, its front flank, i.e. its rear flank has already detached from the driven feed wheel. There would otherwise be a danger of the driven feed wheel being retarded by the crimp fluid flowing into the enclosure within the bounds of backlash.

While the axial sealing surface in the region of the toothed engagement preferably slopes abruptly into the enclosure in the shape of a step, i.e. at least substantially at right angles, it is advantageous if the relieving pocket rises gradually, preferably continuously, up to the axial height of the sealing surface at its other end with respect to the rotational direction of the feed wheel, in particular when the relieving pocket extends slightly into the enclosure, counter to the rotational direction. The relieving pocket can thus rise obliquely, i.e. linearly, or progressively or degressively towards the sealing surface. The gradient or inclination angle should only measure a few degrees, preferably 15° at most, at least towards the end.

In preferred embodiments, an additional relieving pocket—to which the above statements apply similarly—is provided in at least one additional sealing surface which axially faces one of the feed wheels. The axial sealing surface provided with the additional relieving pocket preferably axially faces the same feed wheel or as applicable the other feed wheel, such that crimp fluid can escape on both axial front faces of the feed wheels, towards the high-pressure side. An additional relieving pocket provided on the other side of the feed wheels is more and more advantageous, as compared to only a single relieving pocket, as the width of the feed wheels increases. Even more preferably, each of the axial sealing surfaces is provided with one relieving pocket each, as described, i.e. is formed in accordance with the invention.

In other aspects of the exemplary embodiments, the external toothed wheel pump is limited in its delivery volume in order to be able to adapt the volume flow of the pump according to requirement. The pump can in particular be formed as a self-regulating pump. For limiting the delivery volume, the axial engagement length of the feed wheels can be changed in a way which is usual for external toothed wheel pump, by mounting one of the feed wheels such that it can be axially shifted back and forth relative to the other one. In such embodiments, the relevant feed wheel is part of an axially shifting unit which comprises two pistons and the feed wheel between the pistons, in a sandwiched arrangement. The pistons are axially and linearly guided, secured against rotation, in a casing and each form one of the axial sealing surfaces with respect to the feed wheel. The pressure of the high-pressure side preferably acts constantly on one of the pistons, wherein the corresponding pressure fluid is still removed from the high-pressure side of the delivery chamber, a port arranged downstream of it or advantageously near a unit to be supplied with the high-pressure fluid, and applied to the relevant piston. The other of the two pistons is charged with a regulating force counteracting the high-pressure fluid, preferably an elasticity force which can for example simply be generated by a mechanical spring. If necessary, an auxiliary means can be provided in order to increase or reduce, according to requirement, the restoring force generated by the spring.

In preferred applications, the external toothed wheel pump serves to supply a combustion unit with lubricating oil. The combustion unit can in particular be an internal combustion engine of an automobile.

BRIEF DESCRIPTION OF THE DRAWINGS

An example embodiment of the invention is explained below on the basis of figures. Features disclosed by the example embodiment, each individually and in any combination of features, advantageously develop the subjects of the embodiments described above. There is shown.

DETAILED DESCRIPTION

Figures 1, 1A:
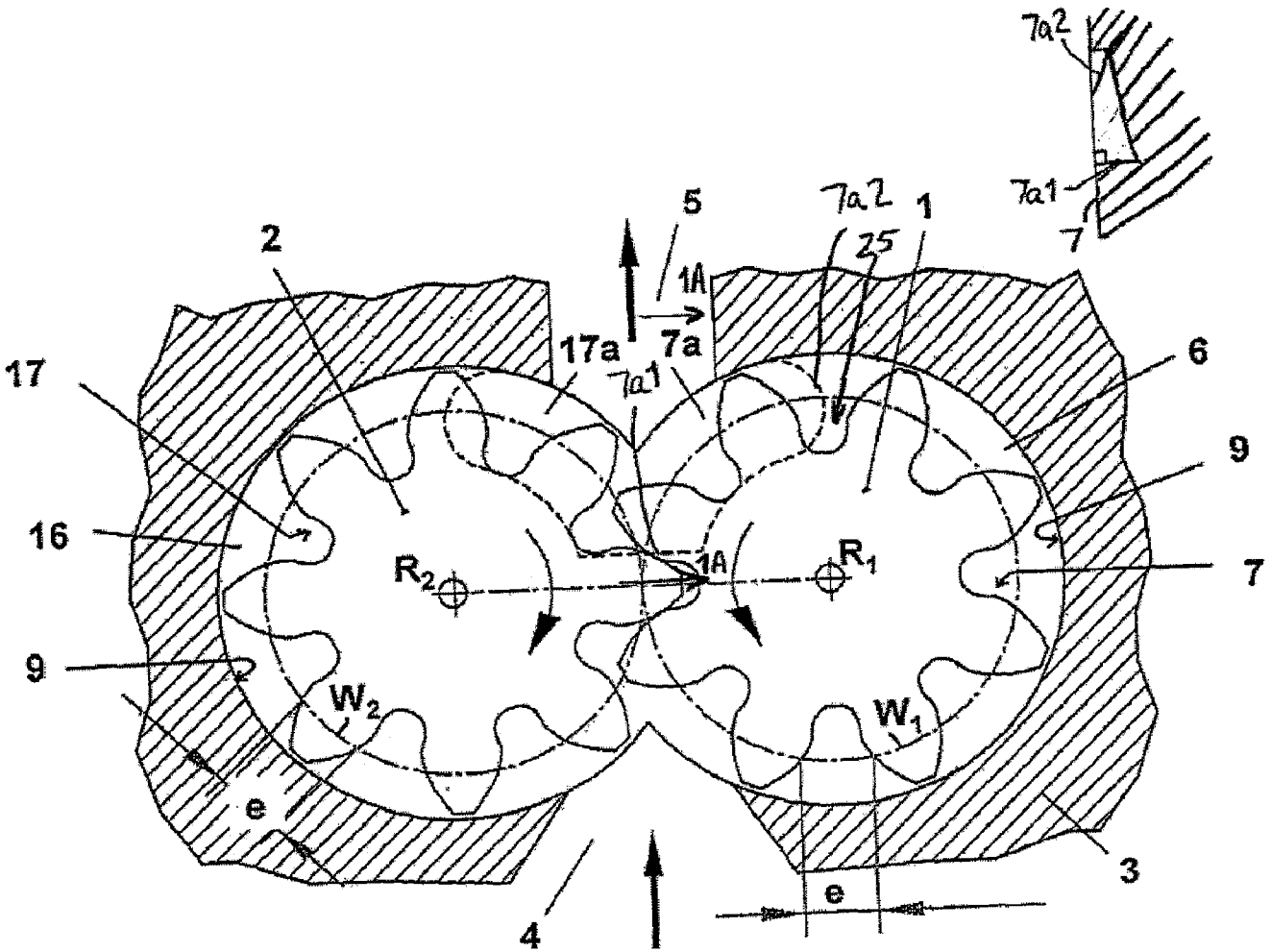
FIG. 1 is a cross-sectional view of a delivery chamber of an external toothed wheel pump, comprising two feed wheels in toothed engagement.
FIG. 1A is a cross-section view along the line 1A-1A in FIG. 1.

FIG. 1 shows a cross-section of an external toothed wheel pump. In a pump casing comprising a casing part 3 and a cover 6 (FIG. 2), a delivery chamber is formed in which two externally toothed feed wheels 1 and 2 are mounted such that they can rotate about parallel rotational axes $R_1$ and $R_2$. The feed wheel 1 is rotationally driven, for example by the crankshaft of an internal combustion engine of an automobile. The feed wheels 1 and 2 are in toothed engagement with each other, such that when the feed wheel 1 is rotationally driven, the feed wheel 2 mating with it is likewise rotationally driven. An inlet 4 feeds into the delivery chamber on a low-pressure side, and an outlet 5 on a high-pressure side, for a fluid to be delivered, preferably lubricating oil for the internal combustion engine. The casing part 3 forms a radial sealing surface 9 which faces each of the feed wheels 1 and 2 in the radial direction and encloses the respective feed wheel 1 or 2 circumferentially, forming a narrow radial sealing gap. For the feed wheel 1, the casing 3, 6 further forms an axial sealing surface on each front face of the feed wheel 1, axially facing it, of which the sealing surface 7 can be seen in FIG. 1. An additional axial sealing surface is formed axially facing each of two front faces of the feed wheel 2, of which the sealing surface 17 can be seen in the cross-section in FIG. 1.

By rotationally driving the feed wheels 1 and 2, fluid is suctioned into the delivery chamber through the inlet 4 and, in the tooth gaps of the feed wheels 1 and 2, delivered through the respective enclosure to the high-pressure side of the delivery chamber, where it is delivered through the outlet 5 to the consumer—in the assumed example, the internal combustion engine. During the delivery action, the high-pressure side is separated from the low-pressure side by the sealing gaps formed between the feed wheels 1 and 2 and the sealing surfaces cited, and by the toothed engagement of the feed wheels 1 and 2. The delivery rate of the pump rises in proportion to the rotational speed of the feed wheels 1 and 2. Since, above a certain limiting rotational speed, the internal combustion engine absorbs less lubricating oil than the pump would deliver in accordance with its characteristic curve which rises in proportion to the rotational speed, the delivery rate of the pump is regulated above the limiting rotational speed. For regulation, the feed wheel 2 can be moved axially, i.e. along its rotational axis $R_2$, back and forth relative to the feed wheel 1, such that the engagement length of the feed wheels 1 and 2, and correspondingly the delivery rate, can be changed.

Figure 2:
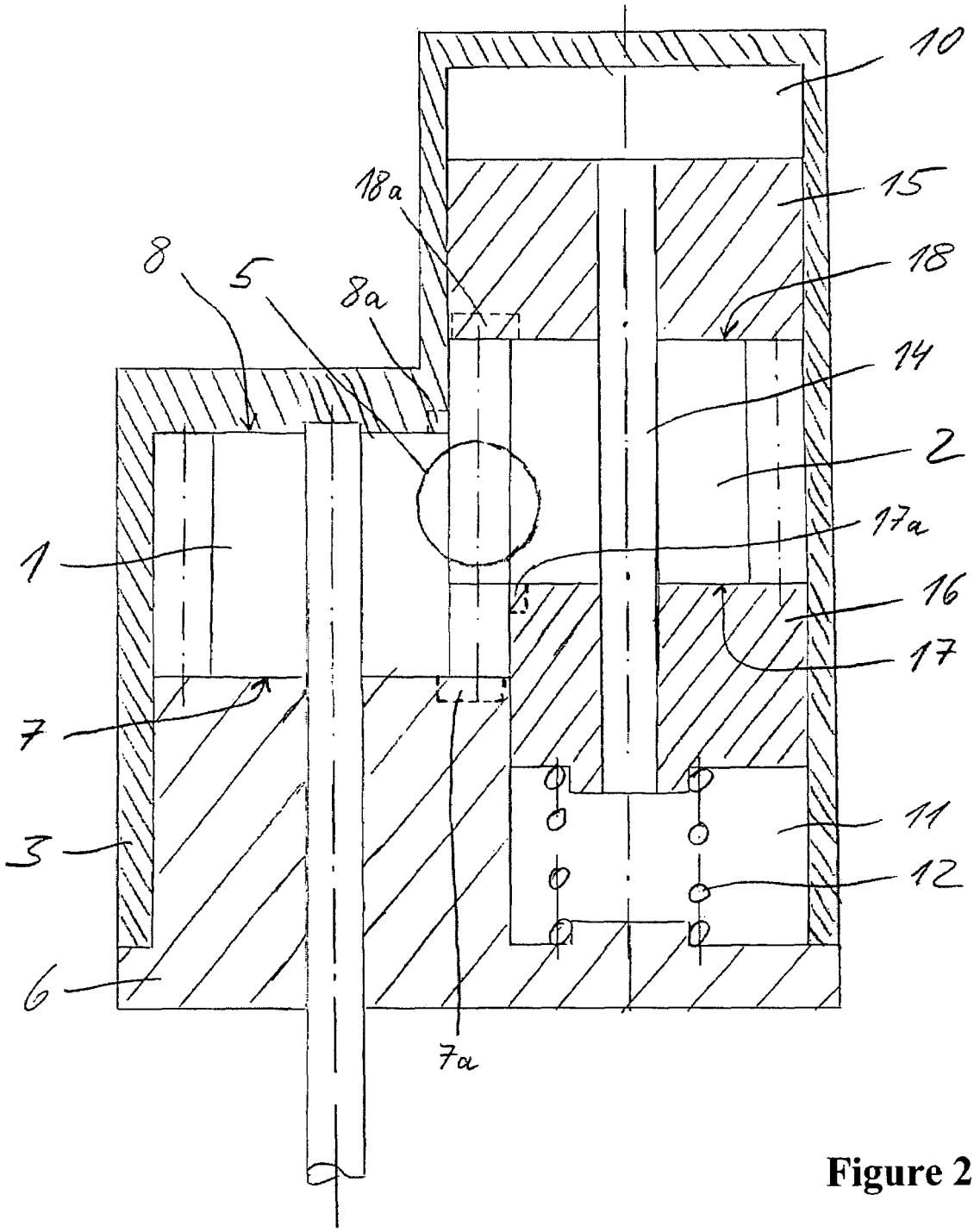
FIG. 2 is a longitudinal cross-sectional view of the external toothed wheel pump.

In FIG. 2, the feed wheel 2 assumes an axial position comprising an axial overlap, i.e. engagement length, which is already reduced as compared to the maximum engagement length. The feed wheel 2 is part of a shifting unit consisting of a bearing journal 14, a piston 15, a piston 16 and the feed wheel 2 which is mounted on the bearing journal 14 between the pistons 15 and 16 such that it can rotate. The bearing journal 14 connects the pistons 15 and 16 to each other, secure against rotation. The piston 16 forms the axial sealing surface 17 facing the feed wheel 2. The piston 15 forms the other axial sealing surface 18. The entire shifting unit is mounted, secured against rotation, in a shifting space of the pump casing 3, 6, such that it can shift axially back and forth. The casing is formed by the casing part 3 and the casing cover 6 which is fixedly connected to it. The casing cover 6 is shaped to comprise a base whose front face facing the feed wheel 1 forms the sealing surface 7. On the opposite front face, the casing part 3 forms the fourth axial sealing surface 8 which axially faces the feed wheel 1. The side of the sealing surface 8 facing the shifting unit is provided with a circular segment-shaped cutaway for the piston 15. The side of the piston 16 facing the feed wheel 1 is provided with a circular segment-shaped cutaway for the base forming the sealing surface 7. Apart from the respective cutaway, the sealing surface 7 corresponds to the sealing surface 8, and the sealing surface 17 corresponds to the sealing surface 18.

The shifting space in which the shifting unit can be moved axially back and forth comprises a partial space 10 which is limited by the rear side of the piston 16 and a partial space 11 which is limited by the rear side of the piston 15. The partial space 10 is connected to the high-pressure side of the pump and is constantly charged with pressure fluid which is diverted there and thus acts on the rear side of the piston 16. A mechanical pressure spring 12 is arranged in the space 11, the elasticity force of which acts on the rear side of the piston 16. The spring 12 counteracts the pressure force acting on the piston 15 in the partial space 10. The regulation of such external toothed wheel pumps is known and does not therefore need to be explained. The regulation can in particular be configured in accordance with DE 102 22 131 B4.

If the axial sealing surfaces 7, 8 and 17, 18 were circumferentially smooth and the axial sealing gaps correspondingly circumferentially narrow, fluid on the high-pressure side in the engagement region of the feed wheels 1 and 2 would be squeezed, i.e. compressed even beyond the pressure of the high-pressure side, and delivered to the low-pressure side. A drive output is consumed for squeezing the fluid, and a delivery flow pulsation is furthermore associated with the particular compression of the fluid and its transport through the toothed engagement.

In order to eliminate the disadvantages cited, the sealing surfaces 7, 8, 17 and 18 are each provided with a relieving pocket 7*a*, 8*a*, 17*a* and 18*a* on the high-pressure side, all four of which can be seen in FIG. 2.

Figure 3:
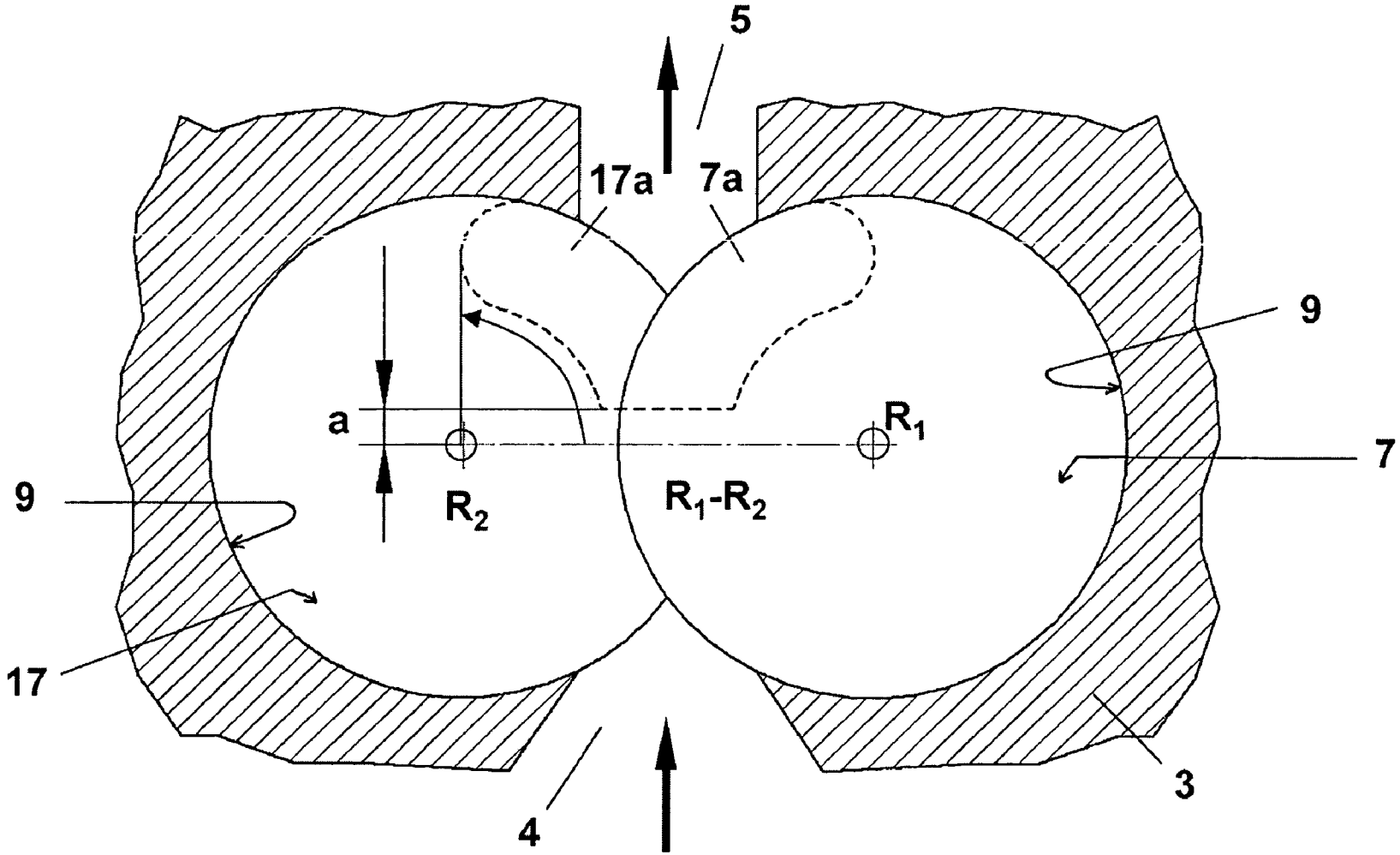
FIG. 3 is a top view onto two axial sealing surfaces of the delivery chamber.

In the representation in FIG. 3, the feed wheels 1 and 2 have been removed, such that in the top view, there is a clear view onto the sealing surfaces 7 and 17. Except for the respective relieving pockets 7*a* and 17*a*, the sealing surfaces 7 and 17 are formed as smooth, planar surfaces and each extend up to the tip circle of the assigned feed wheel 1 or 2. The relieving pockets 7*a* and 17*a* extend radially inwards towards the respective rotational axis $R_1$ and $R_2$, up to the root circle of the assigned feed wheel 1 or 2. Radially outwards, the relieving pockets 7*a* and 17*a* are open, i.e. they extend up to the circumferential edge of their respective sealing surface 7 or 17. The sealing surfaces 7 and 17 each slope abruptly in a step into the respective relieving pocket 7*a* or 17*a* at a sealing edge which runs at a distance "a" parallel to a straight line $R_1$-$R_2$ connecting the rotational axis $R_1$ and $R_2$. The distance "a" measures half a tooth gap width or half a tooth thickness "e" of the assigned feed wheel 1 or 2. The tooth thickness or tooth gap width "e" relevant for measuring the distance "a" is indicated in FIG. 1 and is measured, as is usual, on the reference or pitch circle $W_1$ or $W_2$ of the feed wheel 1 or 2. The feed wheels 1 and 2 exhibit the same tooth thicknesses and tooth gap widths "e". If the tooth thicknesses and tooth gap widths are different, which does not however correspond to the preferred embodiments, the distance is selected such that it at least substantially corresponds to the larger of the two.

The relieving pockets 7*a* and 17*a* extend counter to the rotational direction of the feed wheels 1 and 2 up into the enclosure, namely up into the last tooth gap 25 of the respective feed wheel 1 or 2 which is still completely in the enclosure in all rotational angle positions of the feed wheels 1 and 2. The relieving pocket 7*a* extends far enough into the enclosure that it only engages with the tooth gap of the driven feed wheel 2 when the rear flank of the driving tooth of the driving feed wheel 1 has Just passed the virtual pitch point, such that only its leading tooth flank is still definitively in contact with the driven feed wheel 2. This ensures that there is a definitive driving contact when the crimp fluid first flows into the tooth gap of the driven feed wheel 2 which is still in the enclosure. The relieving pocket 17*a* preferably extends just as far into the enclosure of the driving feed wheel 1. The ends of the relieving pockets 7*a* and 17*a* in the enclosure are distanced from the connecting straight line R1-R2 by an arc length corresponding to about 90°.

While the sealing surfaces 7 and 17 of the respective sealing edge in the engagement region 7*a*1 preferably slope abruptly, i.e. perpendicularly, into the relieving pockets 7*a* and 17*a*, the other ends 7*a*2 of the relieving pockets 7*a* and 17*a* become continuously flatter counter to the rotational direction of the feed wheels 1 and 2, preferably with an inclination angle of 15° at most as measured to the plane of the respective sealing surface 7 or 17.

The relieving pockets 7*a* and 17*a* extend just as far in the rotational direction of the feed wheels 1 and 2. The end of the relieving pocket 17*a* facing the engagement region of the feed wheels 1 and 2 tapers into the circular segment-shaped cutaway for the piston 16, such that the sealing edge of the sealing surface 17 is significantly shorter than the sealing edge of the sealing surface 7 in the engagement region. Apart from this difference, the relieving pockets 7*a* and 17*a* correspond to each other.

The sealing surfaces 8 and 18 on the axially opposite side of the feed wheels 1 and 2 are shaped like the sealing surfaces 7 and 17 and are correspondingly likewise provided, on the high-pressure side only, with relieving pockets 8*a* and 18*a* in the form of the relieving pockets 7*a* and 17*a*. What has been said with respect to the relieving pockets 7*a* and 17*a* applies with regard to these additional relieving pockets. In this respect, the sealing surface 8 opposite the sealing surface 7 corresponds to the sealing surface 17, and the sealing surface 18 corresponds to the sealing surface 7.

Configuring the axial sealing surfaces 7, 8 and 17, 18, in accordance with the invention with a relieving pocket each on the high-pressure side, which furthermore maintain a safety distance "a" from the straight line $R_1$-$R_2$ projected onto the respective sealing surface, ensures that while the pump is relieved of crimp fluid, crimp fluid still cannot however be transported via the toothed engagement or at least only to an extent which is irrelevant for practical purposes, and therefore ensures the greatest possible tightness of seal over the toothed engagement.

In the foregoing description, a preferred embodiment of the invention has been presented for the purpose of illustration and description. It is not intended to be exhaustive or to limit the invention to the precise form disclosed. Obvious modifications or variations are possible in light of the above teachings. The embodiment was chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled to.

What is claimed is:

1. An external toothed wheel pump, comprising:

a) a delivery chamber comprising an inlet and an outlet for a fluid;

b) a first feed wheel and a second feed wheel which can be rotationally driven for delivering the fluid and are in a toothed engagement with each other which separates the outlet from the inlet;

c) and sealing surfaces which axially face the feed wheels and form axial sealing gaps with the feed wheels, d) wherein at least one of the axially facing sealing surfaces comprises a relieving pocket on a high-pressure side of the delivery chamber only and except for the relieving pocket, extends circumferentially up to at least the root circle at the area of the relieving pocket and to the tip circle of the axially facing feed wheel elsewhere, e) wherein the relieving pocket extends counter to the rotational direction of the axially facing feed wheel, up into an enclosure formed by a radial sealing surface of the deliver chamber, and f) wherein the relieving pocket exhibits a distance in the rotational direction of the axially facing feed wheel from a plane extending through the rotational axes of the feed wheels and the distance measures e/2+−e/10, wherein e is the tooth gap width or tooth thickness of the axially facing feed wheel as measured to the pitch circle.

2. The external toothed wheel pump according to claim 1, wherein the distance measures 6e/10 at most.

3. The external toothed wheel pump according to claim 1, wherein the at least one of the sealing surfaces slopes steeply into the relieving pocket at a front edge in the rotational direction of the facing feed wheel.

4. The external toothed wheel pump according to claim 3, wherein the front edge is parallel to a straight line connecting the rotational axes of the feed wheels.

5. The external toothed wheel pump according to claim 1, wherein the relieving pocket becomes gradually flatter at a rear end in the rotational direction of the facing feed wheel.

6. The external toothed wheel pump according to claim 5, wherein the relieving pocket continuously flattens relative to the respective sealing surface in the rotational direction of the facing feed wheel.

7. The external toothed wheel pump according to claim 1, wherein the relieving pocket extends counter to the rotational direction up into a last tooth gap of the axially facing feed wheel which is still completely surrounded by the radial sealing surface.

8. The external toothed wheel pump according to claim 7, wherein the relieving pocket only extends far enough into the enclosure that it only engages with the last tooth gap when the rear flank of a tooth of the driving feed wheel, the front flank of which is in driving contact with the driven feed wheel, has passed a pitch point of the feed wheels.

9. The external toothed wheel pump according to claim 1, wherein the relieving pocket is 3.5 mm deep at most.

10. The external toothed wheel pump according to claim 9, wherein the relieving pocket is 2.5 mm deep at most.

11. The external toothed wheel pump according to claim 1, comprising a shifting unit which is movable axially back and forth and comprises two pistons, between which the second feed wheel is mounted such that it is rotatable, wherein one of the pistons forms the at least one sealing surface comprising the relieving pocket.

12. The external toothed wheel pump according to claim 11, wherein the pistons each form a sealing surface which comprises a relieving pocket on the high-pressure side of the delivery chamber only and except for the relieving pocket, extends circumferentially up to at least the root circle and tip circle of the axially facing feed wheel.

13. The external toothed wheel pump according to claim 1, comprising a shifting unit which is movable axially back and forth and comprises two pistons, between which the second feed wheel is mounted such that it is rotatable, wherein the at least one sealing surface provided with the relieving pocket axially faces the first feed wheel.

14. The external toothed wheel pump according to claim 13, wherein a relieving pocket is formed on the high-pressure side of the delivery chamber only in each of the two sealing surfaces which axially face the first feed wheel, and except for their respective relieving pocket, both sealing surfaces extend circumferentially up to at least the root circle and tip circle of the axially facing feed wheel.

* * * * *